US009028027B2

(12) United States Patent
Bell et al.

(10) Patent No.: US 9,028,027 B2
(45) Date of Patent: May 12, 2015

(54) ALIGNMENT OF PRINTHEADS IN PRINTING SYSTEMS

(71) Applicants: Richard Bell, Longmont, CO (US); Carl R Bildstein, Lafayette, CO (US); Stuart J. Boland, Denver, CO (US); Scott R. Johnson, Erie, CO (US); Casey E. Walker, Boulder, CO (US)

(72) Inventors: Richard Bell, Longmont, CO (US); Carl R Bildstein, Lafayette, CO (US); Stuart J. Boland, Denver, CO (US); Scott R. Johnson, Erie, CO (US); Casey E. Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 62 days.

(21) Appl. No.: 13/933,582

(22) Filed: Jul. 2, 2013

(65) Prior Publication Data

US 2015/0009262 A1 Jan. 8, 2015

(51) Int. Cl.

| | |
|---|---|
| ***B41J 29/38*** | (2006.01) |
| ***B41J 11/46*** | (2006.01) |
| ***B41J 15/04*** | (2006.01) |
| ***B41J 25/00*** | (2006.01) |
| ***B41J 2/21*** | (2006.01) |
| ***B41J 11/00*** | (2006.01) |

(52) U.S. Cl.

CPC ..... *B41J 11/46* (2013.01); *B41J 15/046* (2013.01); *B41J 25/001* (2013.01); *B41J 2/2146* (2013.01); *B41J 11/0095* (2013.01)

(58) Field of Classification Search

CPC ..... B41J 2/04505; B41J 2/04556; B41J 2/04558; B41J 2/2135; B41J 11/0045; B41J 11/0055; B41J 11/008; B41J 11/20; B41J 15/046

USPC ..... 347/9, 14, 16, 19, 37, 101, 104

See application file for complete search history.

(56) References Cited

U.S. PATENT DOCUMENTS

| | | | | |
|---|---|---|---|---|
| 4,572,417 | A | 2/1986 | Joseph et al. | |
| 6,701,837 | B2 | 3/2004 | Ohba et al. | |
| 6,989,853 | B2 | 1/2006 | Ream et al. | |
| 7,798,587 | B2 | 9/2010 | Mizes et al. | |
| 8,075,080 | B2 | 12/2011 | Albertalli | |
| 8,075,086 | B2 * | 12/2011 | Mizes | 347/19 |
| 8,270,024 | B2 | 9/2012 | Brown et al. | |
| 8,419,144 | B2 | 4/2013 | Castillo et al. | |
| 2002/0126169 | A1 | 9/2002 | Wyngaert et al. | |
| 2010/0150632 | A1 | 6/2010 | Matsumoto et al. | |
| 2010/0243697 | A1 | 9/2010 | Aoki | |
| 2011/0273502 | A1 | 11/2011 | Eun et al. | |
| 2011/0298849 | A1 | 12/2011 | Murayama et al. | |
| 2012/0223996 | A1 | 9/2012 | Ernst et al. | |
| 2013/0050314 | A1 | 2/2013 | Duke et al. | |

FOREIGN PATENT DOCUMENTS

| | | |
|---|---|---|
| WO | WO2011134487 | 11/2011 |

* cited by examiner

*Primary Examiner* — Juanita D Jackson

(74) *Attorney, Agent, or Firm* — Duft Bornsen & Fettig LLP

(57) ABSTRACT

Systems and methods are provided for aligning printheads of a printing system. The system comprises a sensor and a controller. The sensor is able to detect changes in a lateral position of a web of print media traveling through a continuous-forms printing system, and the controller is able to adjust a lateral position of a printhead while the printing system is operating to compensate for the detected changes in web position.

20 Claims, 8 Drawing Sheets

ALIGNMENT OF PRINTHEADS IN PRINTING SYSTEMS

FIELD OF THE INVENTION

The invention relates to the field of printing systems, and in particular, to alignment of printheads in continuous-forms printing systems.

BACKGROUND

Entities with substantial printing demands typically use a production printer. A production printer is a high-speed printer used for volume printing (e.g., one hundred pages per minute or more). Production printers include continuous-forms printers that print on a web of print media stored on a large roll.

A production printer typically includes a localized print controller that controls the overall operation of the printing system, and a print engine (sometimes referred to as an "imaging engine" or a "marking engine"). The print engine includes one or more printhead assemblies, with each assembly including a printhead controller and a printhead (or array of printheads). An individual printhead includes multiple (e.g., hundreds of) tiny nozzles that are operable to discharge ink as controlled by the printhead controller. A printhead array is formed from multiple printheads that are spaced in series across the width of the web of print media.

While printing, the web is quickly passed underneath the nozzles, which discharge ink at intervals to form pixels on the web. In order to ensure that the web is consistently positioned underneath the nozzles, steering systems can be used to align the web laterally with respect to its direction of travel. For example, these steering systems can be calibrated when the printer is first installed. However, even when the web is aligned, fluctuations in the physical properties of the web itself (e.g., small micron-level variations along the edge of the web, lateral tension variation along the web, orientation of the fibers in the web, etc.) can cause the web to experience lateral shifts during printing. This means that printed output for a print job can appear to shift back and forth across the pages of a document. Even though the individual shifts can be small (e.g., on the order of microns), the shifts can reduce print quality. For example, when multiple printheads are used by a printer to form a mixed color pixel, a small fluctuation in web position can cause an upstream printhead to mark the correct physical location, while a downstream printhead marks the wrong physical location. This distorts the final color of the pixel in the printed job.

SUMMARY

Embodiments described herein adjust the lateral position of one or more printheads during printing in order to ensure that the printheads mark the correct positions along the width of a web of print media. These systems and methods can dynamically adjust themselves to account for fluctuations at the web that occur while a job is printing.

One embodiment is a system for aligning printheads of a printing system. The system comprises a sensor and a controller. The sensor is able to detect changes in a lateral position of a web of print media traveling through a continuous-forms printing system, and the controller is able to adjust a lateral position of a printhead while the printing system is operating to compensate for the detected changes in web position.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
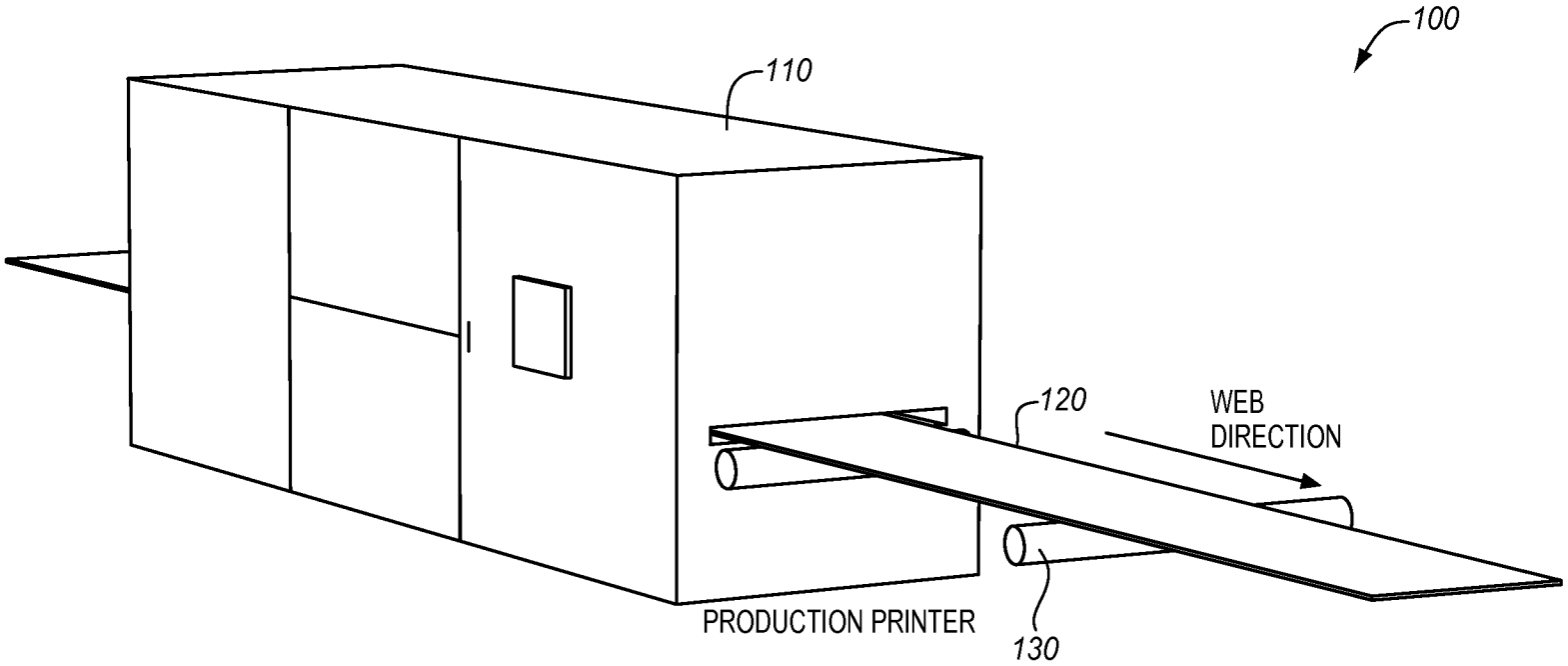
FIG. 1 illustrates an exemplary continuous-forms printing system.

FIG. 1 illustrates an exemplary continuous-forms printing system 100. Printing system 100 includes production printer 110, which is operable to apply ink onto a web 120 of continuous-form print media (e.g., paper). As used herein, the word "ink" is used to refer to any suitable marking fluid (e.g., aqueous inks, oil-based paints, etc.). Printer 110 may comprise an inkjet printer that applies colored inks, such as Cyan (C), Magenta (M), Yellow (Y), and Key (K) black inks One or more rollers 130 position and tension web 120 as it travels through printing system 100.

Figure 2:
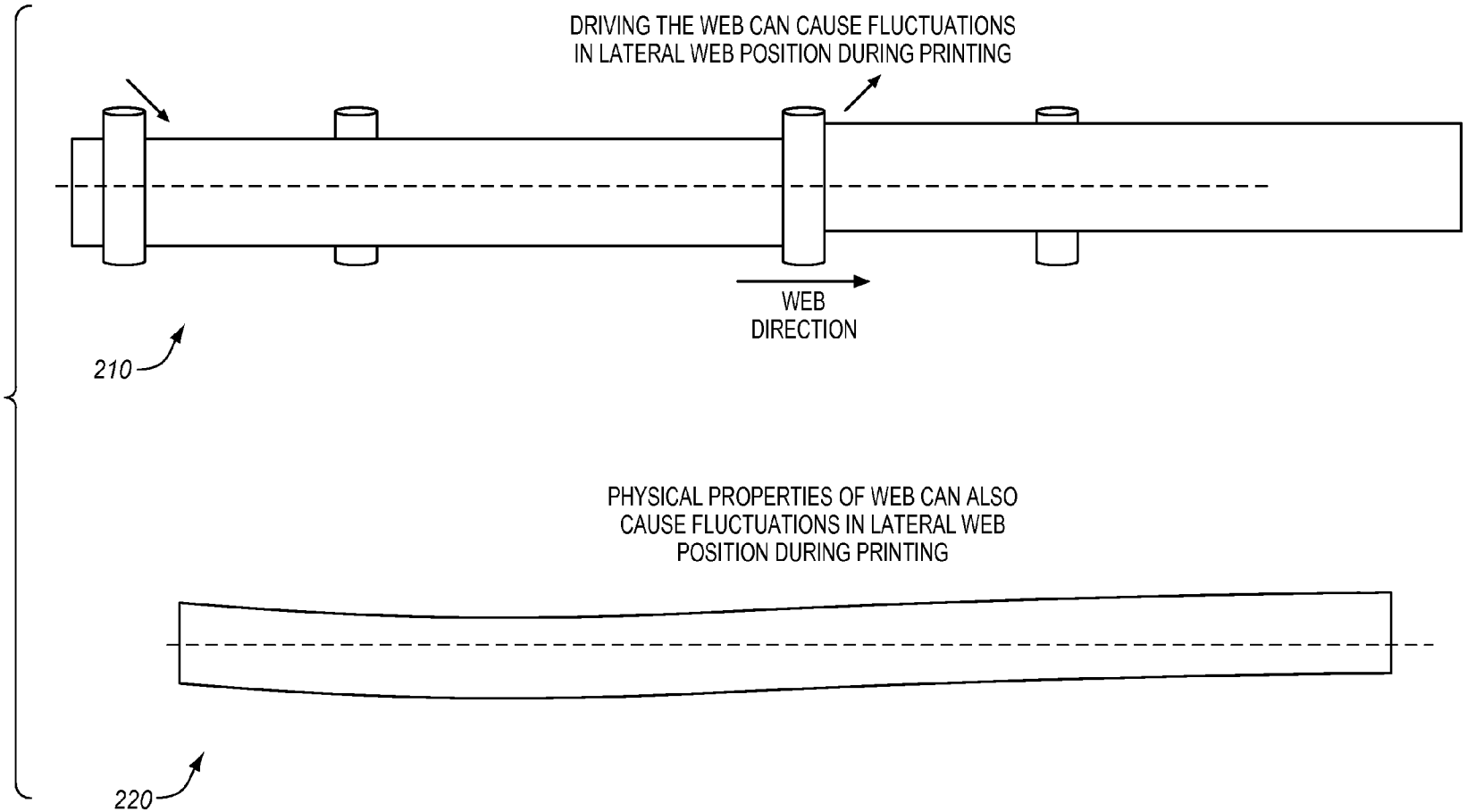
FIG. 2 illustrates how a web of print media can oscillate laterally within the printing system of FIG. 1 during printing.

FIG. 2 illustrates how a web of print media can shift laterally within the exemplary printing system 100 of FIG. 1 during printing. For example, FIG. 2 at element 210 illustrates that rollers can impart lateral shifts to a web of print media. As used herein, a lateral shift is a positional change that is within the plane of the web and orthogonal to the direction of travel of the web (i.e., orthogonal to the length of the web, and parallel to the width of the web).

As shown in element 210, before traveling through a roller the lateral position of the web (with respect to the web's direction of travel) is above the dashed reference line. After traveling through the roller, it is below the reference line. Furthermore, the degree of lateral shifting imparted by printing system 100 itself can oscillate in amplitude and direction while printing system 100 is operating. In short, the very act of driving the web can cause the web to laterally oscillate back and forth. No static adjustments can compensate for these oscillating lateral shifts that occur during printing.

FIG. 2 at element 220 shows that the web itself can also contribute to lateral fluctuations. Element 220 shows that a web may have an uneven edge. For example, some webs of print media are initially cut with a blade. When a long cut is being made, the blade itself can oscillate laterally back and forth at a certain frequency by very small amounts (e.g., a few microns). This in turn imparts an uneven edge to the web. Since many printheads maintain the same absolute position while printing, the distance of printed marks relative to the edge of the paper will vary as the edge of the paper itself varies, which can reduce print quality.

Figure 3:
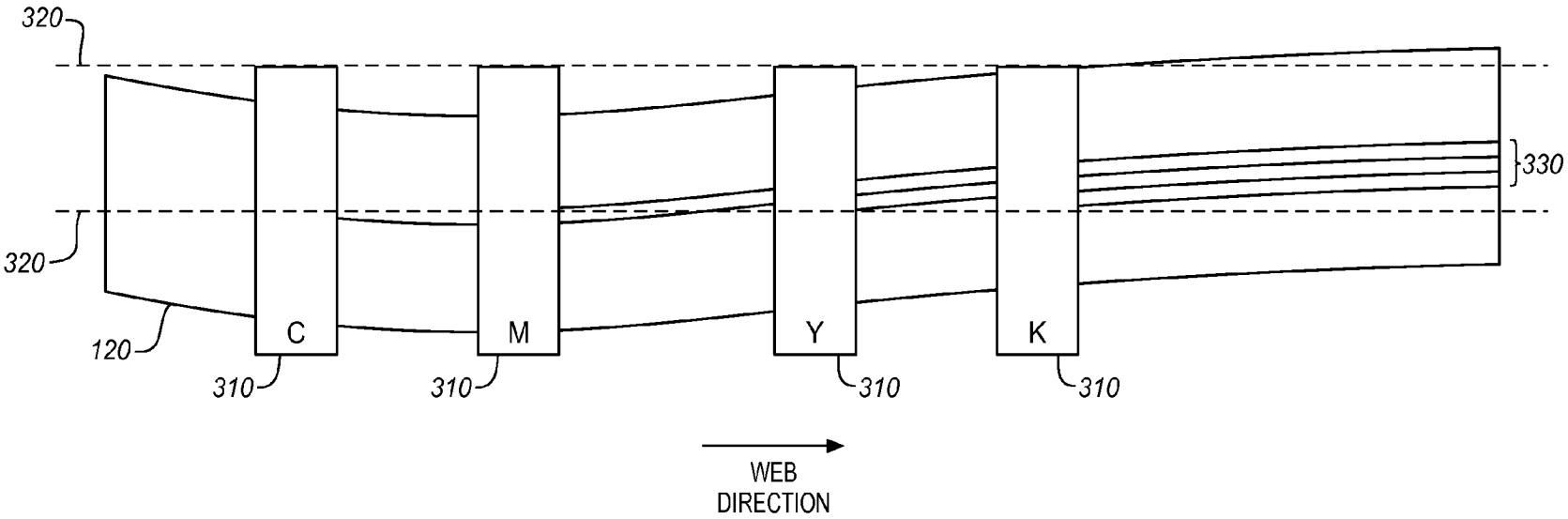
FIG. 3 is a diagram illustrating exemplary problems resulting from lateral web oscillations in a printing system that uses multiple color planes.

FIG. 3 is a diagram illustrating exemplary problems resulting from lateral web oscillations in a printing system that uses multiple color planes. In this case, each printhead 310 acts as a color plane for one of cyan, magenta, yellow, and key black. In FIG. 3, each printhead 310 is aligned in the same position relative to its peers, as indicated by reference lines 320. When the printheads are aligned in this manner, they will all mark exactly the same lateral position with respect to each other. Unfortunately, because the position of web 120 fluctuates in between the printheads, ink marked by each printhead 310 actually shows up in a different lateral position at web 120, as shown by element 330. This color plane separation occurs even though each of printheads 310 is marking the exact same lateral position with respect to its peers.

Figure 4:
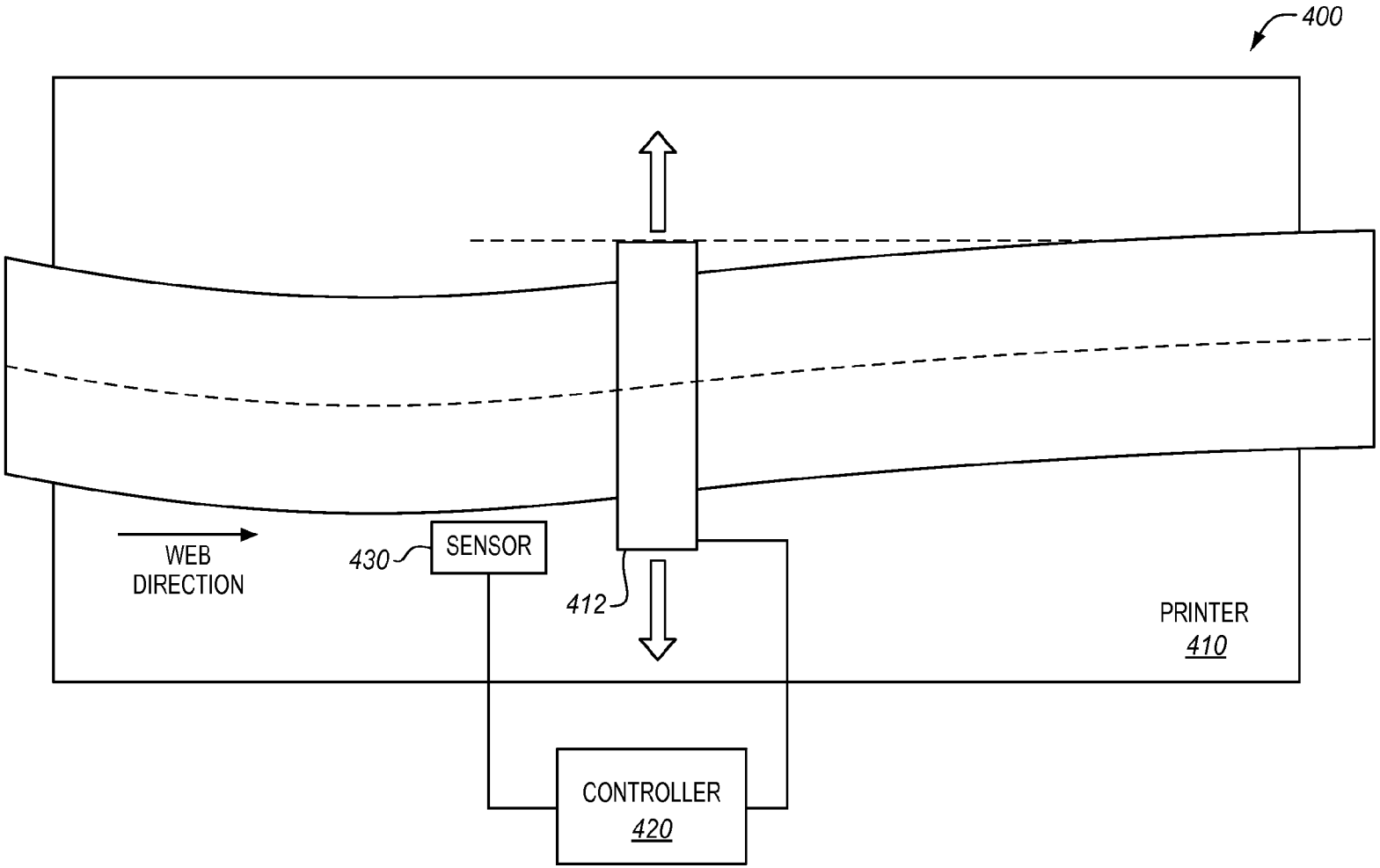
FIG. 4 is a block diagram illustrating a printing system that accounts for lateral shifts at a web of print media in an exemplary embodiment.

To address these problems with printhead alignment, FIG. 4 illustrates a printing system 400 that accounts for lateral shifts at a web of print media in an exemplary embodiment. Printing system 400 comprises any system, component, or device operable to mark a web of print media. Printing system 400 has been enhanced to adjust the lateral position of printhead 412 with respect to the direction of travel of the web during printing.

In this embodiment, printing system 400 includes printer 410, which has one or more printheads 412 used to mark ink onto web 120. Printing system 400 also includes a printhead positioning system, which is made up of controller 420 and web position sensor 430. Web position sensor 430 detects the lateral position of the web before it reaches printhead 412, and controller 420 adjusts the lateral position of printhead 412 during printing to compensate for the changing position of the web during printing.

Sensor 430 comprises any system, component, or device operable to detect positional shifts in the web. For example, sensor 430 can comprise a laser, pneumatic, photoelectric, ultrasonic, infrared, optical, or any other suitable type of sensing device. Sensor 430 is placed upstream of printhead 412 with respect to the direction of travel of the web during printing. In one embodiment, sensor 430 detects the location of a physical edge of the web, while in another embodiment, sensor 430 detects a position of the web based on marks made by an upstream printhead.

Controller 420 comprises any system, component, or device operable to control the position of printhead 412, based on changes in lateral position detected by sensor 430. For example, controller 420 may direct a positioning device to physically move printhead 412 as shown by the arrows in FIG. 4 to account for detected changes. Controller 420 can be implemented, for example, as custom circuitry, as a processor executing programmed instructions stored in an associated program memory, or some combination thereof.

The positioning device can comprise a linear actuator, a movable printhead assembly that can reposition itself by driving itself along a fixed rail, or any other suitable system capable of moving printhead 412.

Illustrative details of the operation of printing system 400 will be discussed with regard to FIG. 5. Assume, for this embodiment, that printer 410 has started printing, and that during printing the web is being driven underneath printhead 412. Further, assume that the lateral position of the web is shifting slightly back and forth due to the web being driven.

Figure 5:
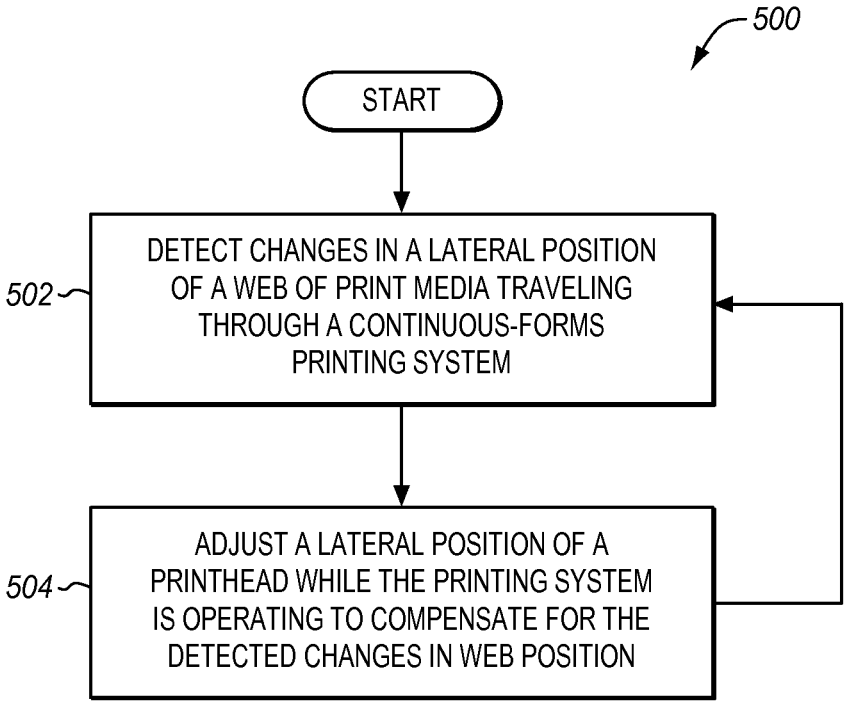
FIG. 5 is a flowchart illustrating a method of accounting for lateral shifts at a web of print media in an exemplary embodiment.

FIG. 5 is a flowchart illustrating a method of accounting for lateral shifts at a web of print media in an exemplary embodiment. The steps of method 500 are described with reference to printing system 400 of FIG. 4, but those skilled in the art will appreciate that method 500 may be performed in other systems. The steps of the flowcharts described herein are not all inclusive and may include other steps not shown. The steps described herein may also be performed in an alternative order.

In step 502, sensor 430 detects changes in the lateral position of the web traveling through printing system 400. These changes are reported to controller 420, which may analyze the detected changes before taking action. For example in one embodiment controller 420 ignores variations that are below a certain threshold level (e.g., a micron).

In step 504, controller 420 adjusts the lateral position of printhead 412 while printing system 400 is operating to compensate for the detected changes in the position of the web. In one embodiment, controller 420 directs a positioning device to move printhead 412 based on the detected changes. For example, if controller 420 detects that the web has shifted to the upward with respect to FIG. 4 by fifty microns, then it may direct the positioning device to move printhead 412 upward by fifty microns to match the web shift. Controller 420 may additionally implement a positioning "lag time" based on the distance between sensor 430 and printhead 412 and the speed at which the web is currently traveling. For example, if sensor 430 is positioned one and a half seconds upstream of printhead 412, controller 420 can implement a lag time to ensure that printhead 412 has moved to its new position after one and a half seconds (e.g., by implementing an input delay for an actuator driving printhead 412).

Method 500 can repeat continuously during printing so that lateral shifts in the web are consistently identified and addressed. This allows printing system 400 to dynamically account for lateral movement at the web during printing, even when the web moves unpredictably. Better positioning of printheads with respect to the web ensures greater print quality, and in systems that use multiple colors of ink, it also helps to ensure that printed colors are accurately marked onto the print media.

In a further embodiment, controller 420 may process input from sensor 430 with a lowpass filter before attempting to correct shifts in the position of the web. A lowpass filter (in, for example, the 2 Hertz (Hz) range) can help to keep controller 420 from responding to high-frequency noise when repositioning printhead 412.

In another embodiment, controller 420 may identify an acceleration limit for printhead 412 when printhead 412 is being repositioned. Controller 420 then keeps printhead 412 from exceeding the defined limit. If printhead 412 is accelerated too quickly when it is being moved, the original momentum of printhead 412 can cause it to overshoot its intended final location. This in turn can cause positioning errors at printhead 412 when printhead 412 overshoots its target location.

Figure 6:
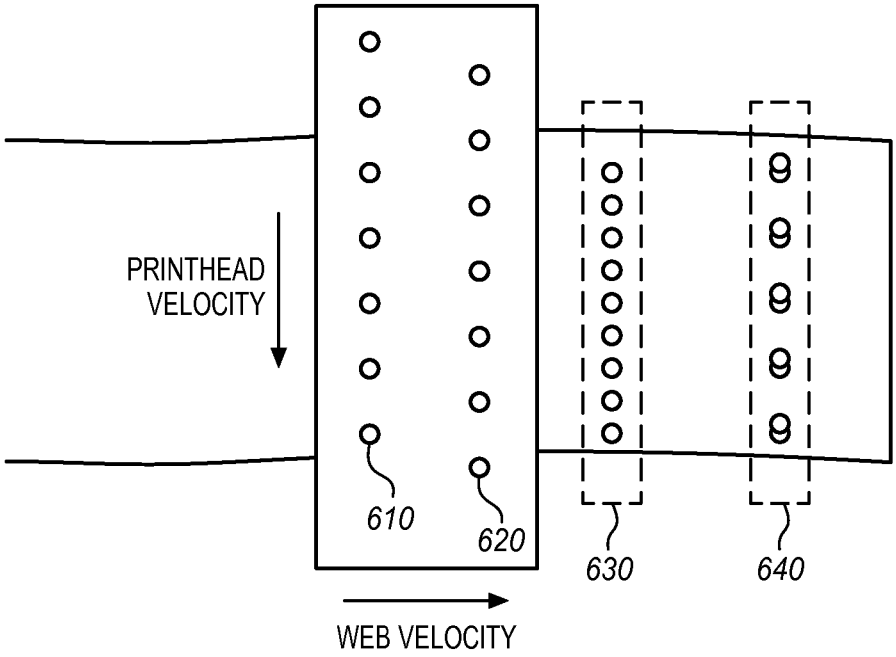
FIG. 6 is a diagram illustrating an exemplary printhead being repositioned over a web of print media.

In another embodiment, controller 420 identifies a limit for a speed of printhead 412 when printhead 412 is being repositioned. Controller 420 then keeps printhead 412 from exceeding the defined velocity limit. FIG. 6 is a diagram illustrating an exemplary printhead being repositioned over a web of print media, and FIG. 6 helps to illustrate potential problems with moving a printhead too quickly. In FIG. 6, the printhead is made up of multiple rows of nozzles, 610 and 620. Each row is located at a different location with respect to the direction of travel of the web. After printing, the ink from the rows of nozzles should be evenly distributed, as shown by element 630. However, if the entire printhead is moved too quickly laterally across the web, row 620 of the printhead may print at a different location than intended relative to row 610. Even though the output from the rows is intended to be evenly distributed, as shown by element 630, the output appears jittery as shown by element 640. In short, when the motion of the printhead is substantial and the printhead is printing while it is being repositioned, each row can mark a different lateral position on the web than intended. A speed limit for the printhead can help to address this problem.

In a further embodiment, controller 420 can identify a resonant frequency of printing system 400. A resonant frequency of printing system 400 is a frequency of motion that amplifies the vibration that naturally occurs within printing system 400 during printing. Resonant vibrations at printing system 400 can cause damage to its components.

Once controller 420 determines the resonant frequencies of printing system 400 (e.g., by consulting values stored in memory), controller 420 can take measures to keep from increasing resonant vibrations at printing system 400 when it moves one or more printheads 412 back and forth. To this end, controller 420 can apply a stopband filter to input from sensor 430, in order to stop from measuring (and therefore attempting to correct) vibrations of printing system 400 that occur at the resonant frequency. This can be desirable, as correcting for motions of the web at resonant frequencies can in some cases increase vibrations at printing system 400 and damage it. However, in some embodiments a stopband filter is not applied, meaning that corrections for vibrations at the natural frequency of the printing system can be applied.

EXAMPLES

In the following examples, additional processes, systems, and methods are described in the context of a printing system that adjusts printhead position with respect to a web of print media during printing.

Figure 7:
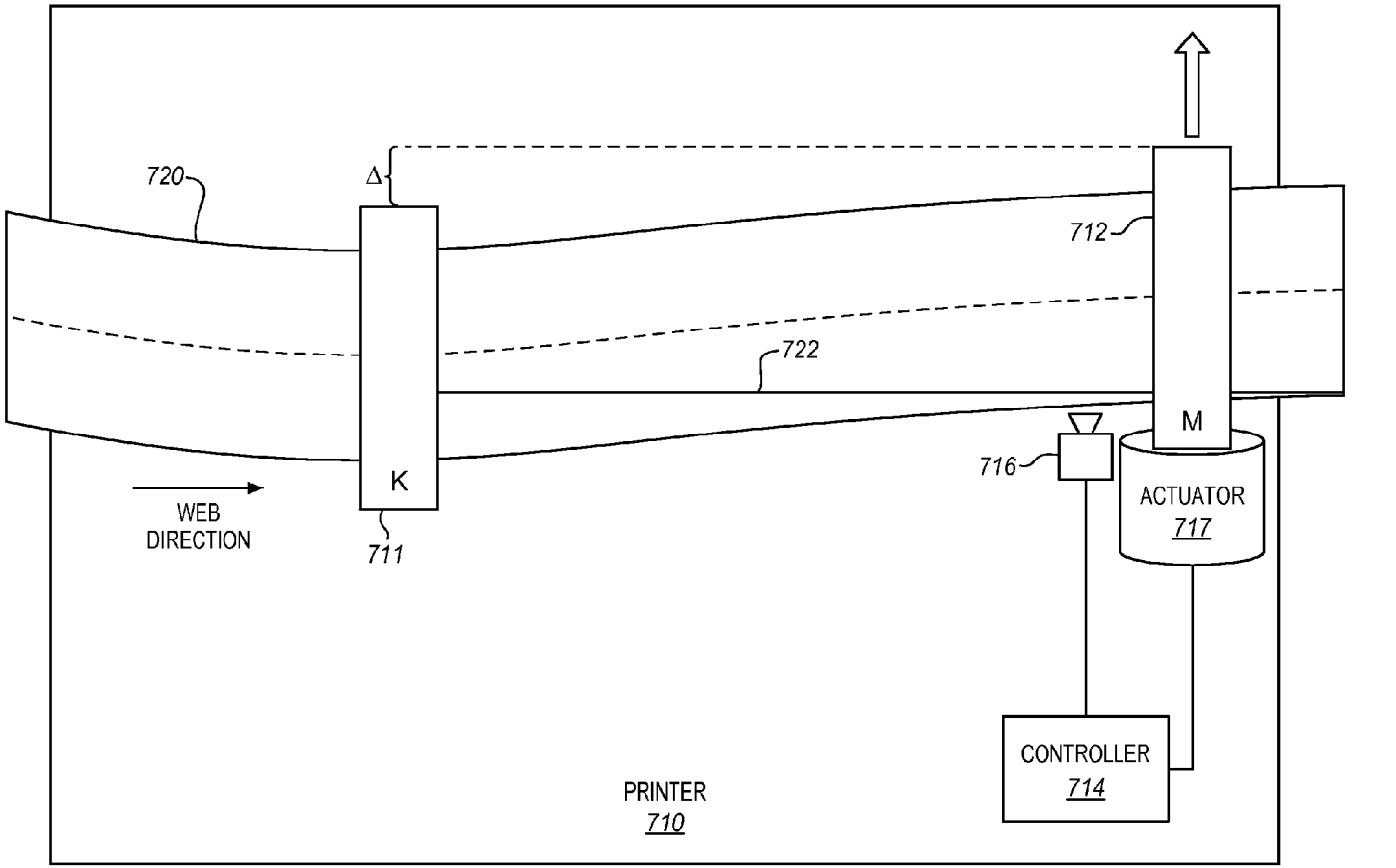
FIG. 7 is a block diagram illustrating a further exemplary printing system that accounts for lateral shifts at a web of print media.

FIG. 7 is a block diagram 700 illustrating a further exemplary printing system that accounts for lateral shifts at a web of print media. In this embodiment, the printing system includes two inkjet printers used to print incoming jobs. Each printer includes two printhead arrays, and each printhead array is used as a color plane to mark a different color of ink onto a web 720 of print media. The upstream printer 710 marks black and magenta ink onto web 720 print media, while the downstream printer (not shown) marks cyan and yellow ink onto web 720.

While a job is being printed, web 720 travels through the printing system at a rate of eight linear feet per second, and the lateral position of web 720 fluctuates back and forth. The printing system corrects lateral deviations at web 720 that are between about five microns and several hundred microns, occurring at a rate of about 0.1 to 2 Hertz (Hz). In order to calibrate the corrections made by the various printhead arrays, the furthest upstream printhead array 711 (here, the printhead array responsible for the black color plane) makes a gutter mark 722 onto web 120. In this example the gutter mark is located in a margin of web 720, which will later be cut from web 720 before the print job is delivered to a customer. Mark 722 extends along web 720 in the direction of the flow for web 720, and marks a specific lateral location on printhead array 711. While mark 722 is shown as a solid line, it can be generated as any suitable visual indicator (e.g., single marks spaced out at defined intervals).

To account for the positional shifts of upstream printhead array 711 with respect to web 720, printer 710 uses a camera 716 to detect a position of mark 722 on web 720. When the lateral position of mark 722 changes, controller 714 analyzes a lateral distance between the mark and a reference location on printhead array 712, and drives linear actuator 717 to adjust the position of printhead array 712 so that by the time the mark reaches printhead array 712, printhead array 712 will be in the appropriate position. In effect, controller 714 moves printhead array 712 by some distance $\Delta$ to ensure that the magenta color plane is aligned with the black color plane (i.e., in order to account for the shift in web 720 as it travels between the color planes). Each of the color planes in the downstream printer (not shown) use similar systems to laterally align themselves to the first printhead array.

In further embodiments, each color plane may make one or more gutter marks for reference by the other color planes, or an independent system may apply a gutter mark, such as an ultraviolet or thermal gutter mark invisible to the naked eye.

In another example, a laser thru-beam sensor is placed at printhead array 711 to measure an edge position of the web, and camera 716 is not used. In this example, the lateral edge position of the web at printhead array 711 is compared to a current lateral position of printhead array 712 to determine a lateral distance between the two. Then, printhead 712 is moved (after a suitable time delay based on web speed) to a new position to eliminate/reduce the measured amount of lateral distance between the two.

Figure 8:
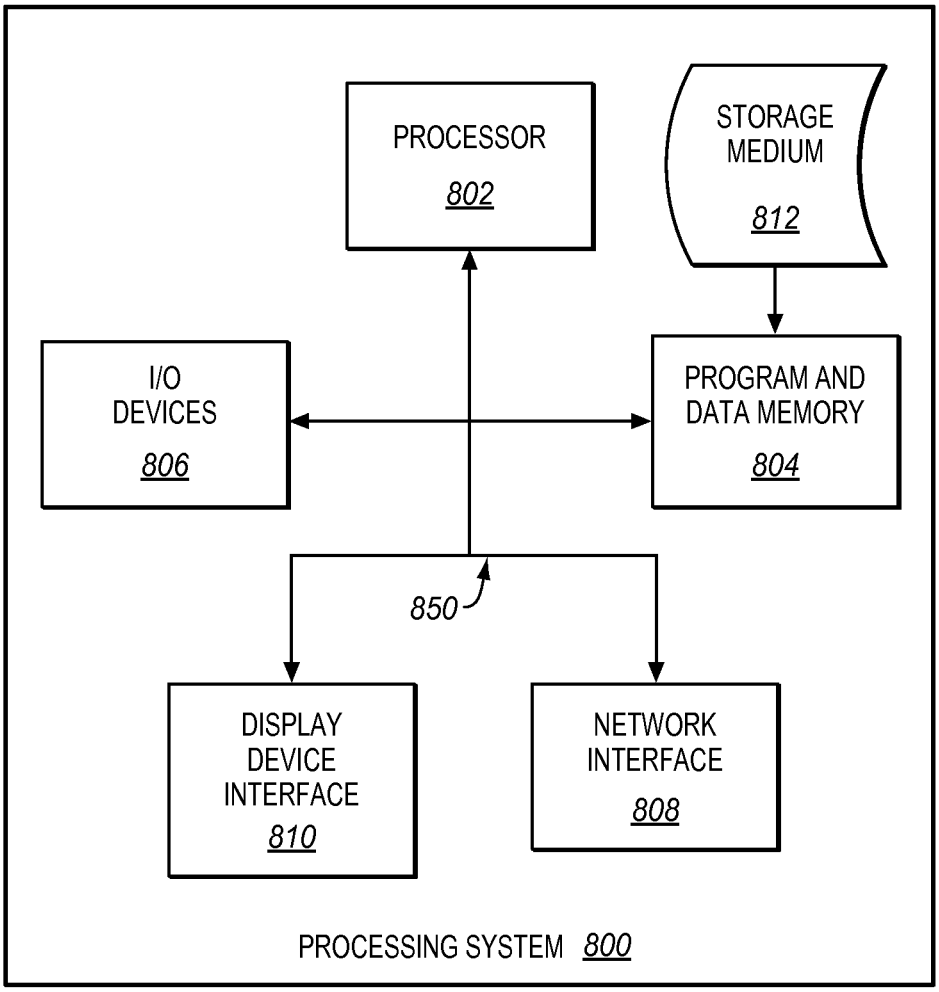
FIG. 8 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of controller 420 to perform the various operations disclosed herein. FIG. 8 illustrates a processing system 800 operable to execute a computer readable medium embodying programmed instructions to perform desired functions in an exemplary embodiment. Processing system 800 is operable to perform the above operations by executing programmed instructions tangibly embodied on computer readable storage medium 812. In this regard, embodiments of the invention can take the form of a computer program accessible via computer-readable medium 812 providing program code for use by a computer or any other instruction execution system. For the purposes of this description, computer readable storage medium 812 can be anything that can contain or store the program for use by the computer.

Computer readable storage medium 812 can be an electronic, magnetic, optical, electromagnetic, infrared, or semiconductor device. Examples of computer readable storage medium 812 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 800, being suitable for storing and/or executing the program code, includes at least one processor 802 coupled to program and data memory 804 through a system bus 850. Program and data memory 804 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 806 (including but not limited to keyboards, displays, pointing devices, etc.) can be coupled either directly or through intervening I/O controllers. Network adapter interfaces 808 may also be integrated with the system to enable processing system 800 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 810 may be integrated with the system to interface to one or more display devices, such as printing systems and screens for presentation of data generated by processor 802.

Although specific embodiments were described herein, the scope of the invention is not limited to those specific embodiments. The scope of the invention is defined by the following claims and any equivalents thereof.

We claim:

1. A system comprising:

a sensor operable to detect changes in a lateral position of a web of print media traveling through a continuous-forms printing system; and a controller operable to adjust a lateral position of a printhead while the printing system is operating to compensate for the detected changes in web position.

2. The system of claim 1, wherein:

the controller is further operable to adjust the lateral position of the printhead based on input from the sensor indicating a location of an edge of the web.

3. The system of claim 1, wherein:

the controller is further operable to adjust the lateral position of the printhead based on input from the sensor indicating a location of marks made on the web by an upstream printhead array.

4. The system of claim 1, further comprising:

a positioning device connected to the printhead; wherein the controller is further operable to direct the positioning device to adjust the position of the printhead.

5. The system of claim 1, wherein:

the controller is further operable to limit a velocity at which the position of the printhead is adjusted.

6. The system of claim 1, wherein:

the controller is further operable to limit an acceleration experienced by the printhead when adjusting the position of the printhead.

7. The system of claim 1, wherein:

the sensor detects the changes in web position at an upstream color plane, and the controller is further operable to determine a lateral distance between a detected position of the web at the upstream color plane and the printhead, and to move the printhead to reduce the lateral distance.

8. The system of claim 1, wherein:

the controller is further operable to identify a resonant frequency of the printing system, and to apply a stop band filter to filter out detected changes occurring at the resonant frequency.

9. A method comprising:

detecting changes in a lateral position of a web of print media traveling through a continuous-forms printing system; and adjusting a lateral position of a printhead of the printing system while the printing system is operating to compensate for the detected changes in web position.

10. The method of claim 9, further comprising:

adjusting the lateral position of the printhead based on input from a sensor indicating a location of an edge of the web.

11. The method of claim 9, further comprising:

adjusting the lateral position of the printhead based on input from the sensor indicating a location of marks made on the web by an upstream printhead.

12. The method of claim 9, further comprising:

directing a positioning device to adjust the position of the printhead.

13. A non-transitory computer readable medium embodying programmed instructions which, when executed by a processor, are operable for performing a method comprising:

detecting changes in a lateral position of a web of print media traveling through a continuous-forms printing system; and adjusting a lateral position of a printhead of the printing system while the printing system is operating to compensate for the detected changes in web position.

14. The medium of claim 13, wherein the method further comprises:

adjusting the lateral position of the printhead based on input from a sensor indicating a location of an edge of the web.

15. The medium of claim 13, wherein the method further comprises:

adjusting the lateral position of the printhead based on input from the sensor indicating a location of marks made on the web by an upstream printhead.

16. The medium of claim 13, wherein the method further comprises:

directing a positioning device to adjust the position of the printhead.

17. The medium of claim 13, wherein the method further comprises:

limiting a velocity at which the position of the printhead is adjusted.

18. The medium of claim 13, wherein the method further comprises:

limiting an acceleration experienced by the printhead when adjusting the position of the printhead.

19. The medium of claim 13, wherein the method further comprises:

detecting the changes in web position at an upstream color plane;

determining a lateral distance between a detected position of the web at the upstream color plane and the printhead;

moving the printhead to reduce the lateral distance.

20. The medium of claim 13, wherein the method further comprises:

identifying a resonant frequency of the printing system; and applying a stop band filter to the detected changes to filter out changes occurring at the resonant frequency.

* * * * *